US005194018A

United States Patent [19]

Lopata et al.

[11] Patent Number: 5,194,018

[45] Date of Patent: Mar. 16, 1993

[54] ELECTRICAL CONNECTOR ASSEMBLY AND METHOD OF FABRICATING SAME

[75] Inventors: John E. Lopata, Naperville, Ill.; Christophe Bouchan, Longjumeau, France

[73] Assignee: Molex Incorporated, Lisle, Ill.

[21] Appl. No.: 823,904

[22] Filed: Jan. 22, 1992

[51] Int. Cl.[5] ..... H01R 13/62

[52] U.S. Cl. ..... 439/540; 439/710; 439/937; 29/884

[58] Field of Search ..... 439/61, 62, 177, 540, 439/712, 713, 717, 710, 937; 29/884

[56] References Cited

U.S. PATENT DOCUMENTS 4,082,408 4/1978 Angelis ..... 439/717 X 4,850,892 7/1989 Walkup et al. ..... 439/326

4,973,267 11/1990 Ramelet ..... 439/710 X

*Primary Examiner*—Eugene F. Desmond

*Attorney, Agent, or Firm*—A. A. Tirva

[57] ABSTRACT

An electrical connector assembly is disclosed to include at least a pair of connector housings having complementary interengaging locking devices for interlocking the connector housings with the centerlines at a first spacing. Frangible webs interconnect the connector housings with their centerlines at a second spacing. Therefore, the connector housings can be used in conjunction with each other at the second spacing, and the frangible webs can be broken to allow interlocking of the connector housings for use in conjunction with each other at the first spacing.

5 Claims, 3 Drawing Sheets

ELECTRICAL CONNECTOR ASSEMBLY AND METHOD OF FABRICATING SAME

FIELD OF THE INVENTION

This invention generally relates to the art of electrical connectors and, particularly, to an electrical connector assembly which includes at least a pair of connector housings interconnectable at selectively different spacings.

BACKGROUND OF THE INVENTION

Various electrical connector assemblies are known in which two or more connector housings are interlockable or interconnectable for use in conjunction with each other to increase the capacity of the assembly. For instance, one type of electrical connector is commonly termed in the art as a SIMM connector or socket which includes an elongated dielectric housing having terminals mounted therein along one side (usually both sides) of an elongated slot defining a centerline of the connector housing. The housing may be mounted on a printed circuit board, with the terminals electrically connected to circuit traces on the board. The slot running the length of the connector housing receives a mating connector or a second printed circuit board with contact pads along one or both sides of an edge of the board. The contacts engage the terminals on the sides of the slot.

With electrical connectors of the character described above, the connector housings sometimes are provided with complementary interengaging locking means whereby a pair of elongated housings can be interlocked in close side-by-side relationship and used in conjunction with each other to provide a "dual row" connector assembly. When the connector housings are interlocked, there is a particular spacing between the centerlines of each connector, i.e. between the centerlines of the connector or board receiving slots. When it is desired to create such a dual row connector assembly on a different centerline spacing, different molds and different assembly machines must be employed to fabricate different sizes of connector housings. Such additional equipment requires additional capital, and the demand for such connector arrays may not justify the additional tooling expense. This creates problems in the versatility of such electrical connectors.

This invention is directed to solving the above problems and satisfying the need for an electrical connector assembly of the character described which can be readily modified to vary the spacing between the connector housings while maintaining the sizes and configurations of the housings, themselves, uniform. Therefore, the molds and tools for fabricating the housings can be maintained of constant dimensions.

SUMMARY OF THE INVENTION

An object, therefore, of the invention is to provide a new and improved electrical connector assembly which includes at least a pair of connector housings which can be readily modified for selectively different spacings when used in conjunction with each other.

In the exemplary embodiment of the invention, the connector housings have complementary interengaging locking means for interlocking the connector housings with their centerlines at a first spacing. Frangible means interconnect the housings with their centerlines at a second spacing. Therefore, the housings can be used in conjunction with each other at the second spacing, and the frangible means can be broken to allow interlocking of the connector housings for use in conjunction with each other at the first spacing.

As disclosed herein, the connector housings are unitarily molded of plastic material and the frangible means is formed integral therewith. As disclosed, the connector housings are elongated and the frangible means include a plurality of breakable webs spaced therealong.

The invention also contemplates a method of fabricating the electrical connector by forming the connector housings with the complementary interengaging locking means and the frangible means. The connector housings thereafter can be used in conjunction with each other at the second spacing, with the frangible means interconnecting the housings, and the frangible means can be broken to allow interlocking of the connector housings for use in conjunction with each other at the second spacing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
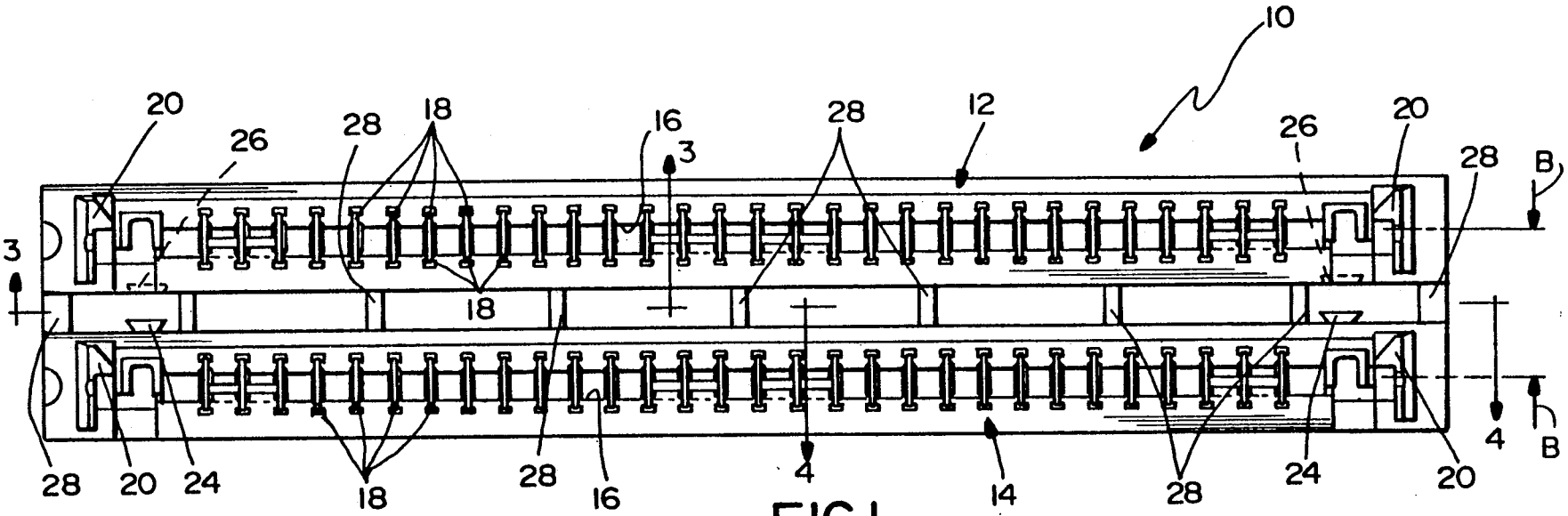
FIG. 1 is a top plan view of an electrical connector assembly embodying the concepts of the invention.

Referring to the drawings in greater detail, and first to FIGS. 1–5, the invention is embodied in an electrical connector assembly, generally designated 10, which includes at least a pair of connector housings, generally designated 12 and 14. As disclosed herein, each connector housing 12 and/or. 14 has the general configuration of what is commonly termed in the art as a SIMM connector or socket. Specifically, the housing is elongated and defines an elongate slot 16 running substantially the length thereof. A plurality of terminals 18 are spaced along at least one side of the slot. As shown, terminals 18 are mounted in the housing and are disposed along both sides of the slot, spaced lengthwise thereof. The slot is provided for receiving a mating connector component or for receiving the edge of a printed circuit board having contact pads along the edge for engaging terminals 18 within slot 16. The connector housings 12 and 14 shown herein are designed for receiving the edges of printed circuit boards, and latch means 20 are provided at opposite ends of the slots for latching the boards in proper mating positions with their edges projecting into the slots.

Figure 3:
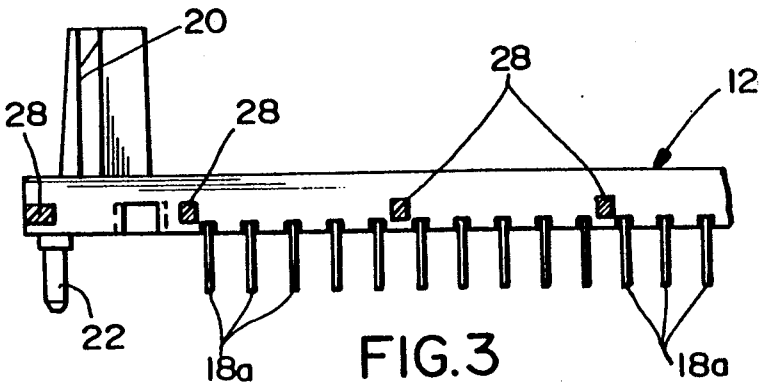
FIG. 3 is a fragmented section taken generally along line 3—3 of FIG. 1.
Figure 4:
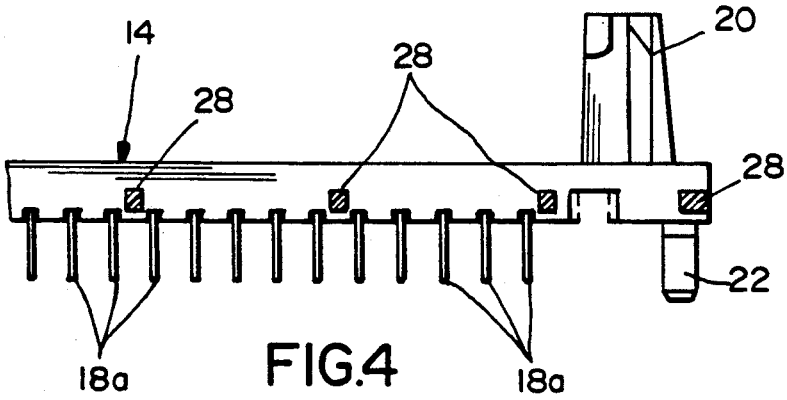
FIG. 4 is a fragmented section taken generally along line 4—4 of FIG. 1.

As seen in FIGS. 3 and 4, each connector housing 12,14 includes a plurality of mounting pegs 22 for insertion into appropriate mounting holes in a second printed circuit board, commonly called the mother board, whereas the board which is inserted into slot 16 is called the daughter board. It can be seen that solder tail portions 18*a* of terminals 18 project from the bottom of the housing for insertion into holes in the printed circuit board to electrically couple the terminals, as by soldering or the like, to respective circuit traces on the board or in the holes. Up to this point, the configurations of connector housings 12 and 14, terminals 18 etc. are generally conventional.

As stated in the "Background" above, individual electrical connectors such as those represented by housings 12 and 14 described above as shown in FIG. 1, sometimes are used in conjunction with each other to create a multi-row connector assembly. For instance, two connector housings such as housings 12 and 14 can be interengaged to provide a dual row connector assembly, i.e. two relatively closely spaced slots 16 for receiving two mating connector components such as a pair of printed circuit boards. When a pair of such housings are used in conjunction with each other, there is a particular spacing between the centerlines of the connectors, i.e. the centerlines of slots 16, which, in turn, define the spacing between the two mating connector components or printed circuit boards. Consequently, this spacing determines the spacing of the terminals, their solder tails and the circuit traces on the printed circuit board. When it is desired to create a connector assembly having a different spacing between the effective centerlines thereof, different sizes of connector housings must be employed. Consequently, different molds, different tooling, different assembly machines and the like must be built to fabricate connector housings with different spacings between slots 16. This additional equipment, molds, tools and the like require additional capital and the demand for the connectors may not justify the expense. Consequently, the utility of such connectors is limited.

The invention contemplates that electrical connector assembly 10 be provided with a system for selectively changing the effective spacing between connector housings 12 and 14 without changing the sizes, dimensions or configurations of the housings and consequently without changing the molding dies and assembly machines.

Figure 5:
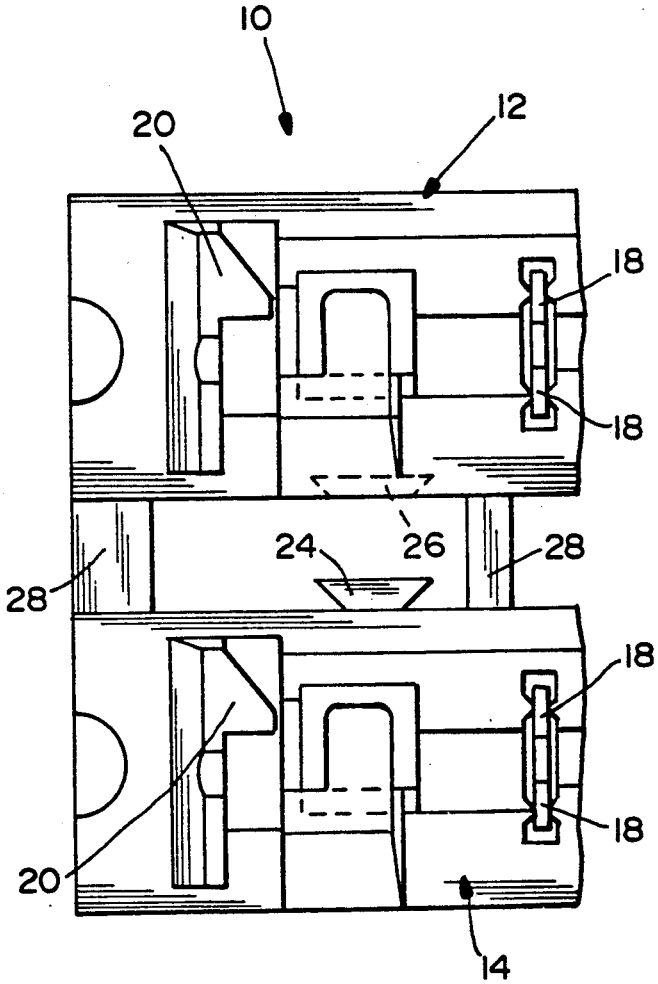
FIG. 5 is a fragmented top plan view, on an enlarged scale, of the left-hand end of the assembly shown in FIG. 1.
Figure 6:
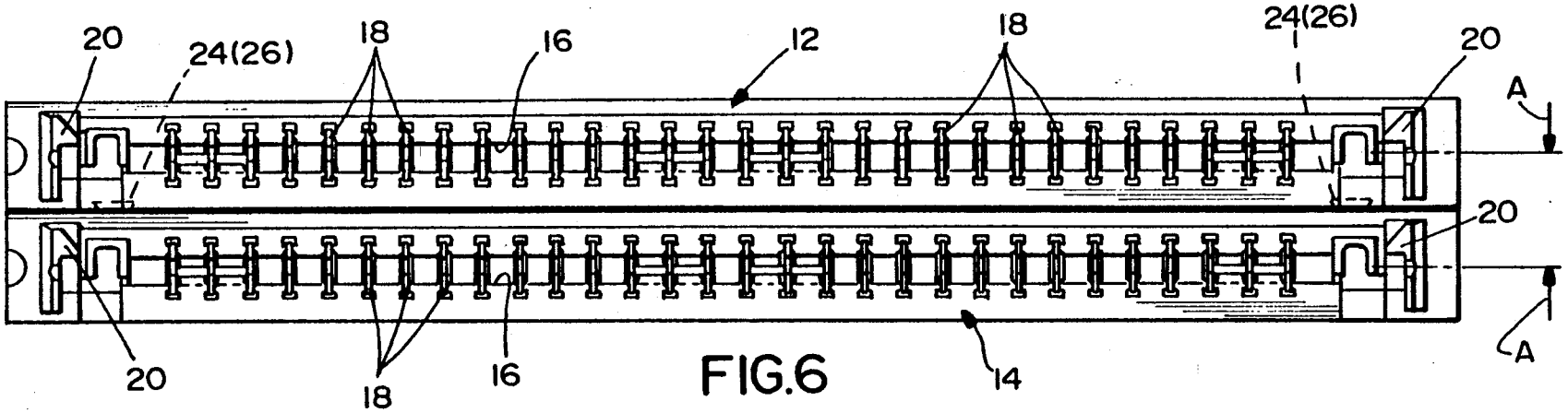
FIG. 6 is a top plan view of the assembly, with the frangible means severed and the connector housings interlocked.
Figure 7:
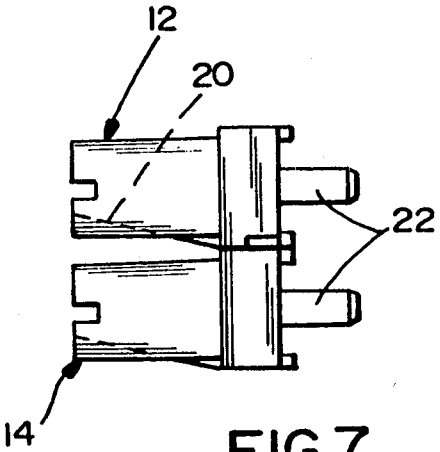
FIG. 7 is an end elevational view looking toward the right-hand end of FIG. 6.

More particularly, generally, complementary interengaging locking means are provided for interlocking the connectors with their centerlines at a first spacing. Specifically, dovetail shaped bosses 24 project outwardly from one side of connector housing 14, and open-bottomed dovetail shaped recesses 26 are formed in an opposing side of connector housing 12. The configuration of the dovetail shaped bosses and the dovetail shaped recesses are best shown in the enlarged depiction of FIG. 5. FIGS. 6 and 7 show the dovetail shaped bosses and recesses interengaged for interlocking connector housing 12 and 14 at a first spacing of their effective centerlines as indicated by arrows "A" (FIG. 6). In essence, the connector housings are interlocked in a close side-by-side relationship and spacing "A" represents the spacing between the centerlines of the respective slots 16 in the connector housings.

Figure 2:
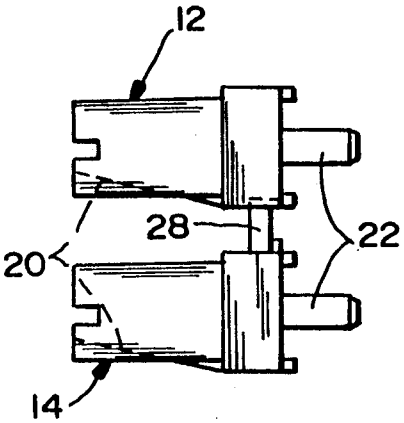
FIG. 2 is an end elevational view looking toward the right-hand end of FIG. 1.

However, referring back to FIGS. 1–5, the invention contemplates that electrical connector assembly 10 be initially fabricated, generally, with frangible means 28 for interconnecting the connector housings with their centerlines at a second or different spacing as represented by arrows "B" (FIG. 1). More particularly, the frangible means are provided by a plurality of removeable webs 28 which join the connector housings as best shown in FIGS. 1, 2 and 5. Preferably, connector housings 12 and 14, including their latch means 20, mounting posts 22, dovetail bosses 24 and dovetail recesses 26 are molded unitarily of dielectric material such as plastic or the like. The invention contemplates that frangible or breakable webs 28 be molded integrally with the housings so that the entire assembly, minus terminals 18, as shown in FIG. 1 can be unitarily fabricated.

From the foregoing detailed description, it can be understood that the entire unitarily molded assembly 10 can be fabricated; terminals 18 can be mounted in the housing; and the connector assembly can be shipped to a customer in that configuration. The customer then has the option of using the connector assembly either with frangible webs 28 joining the connector housings to space the effective centerlines of the housings at a given distance as represented by arrows "B" (FIG. 1), or the customer can break the housings apart, removing frangible webs 28 and interlock the housings by dovetail bosses and recesses 24 and 26, respectively, whereby the housings can be used in conjunction with each other at the effective centerline spacing represented by arrows "A" (FIG. 6). Of course, if customers require high volume of housings with "A" spacing, the housings can be assembled and shipped in with the "A" spaced. It can be seen that the connector housings can be used at different effective centerline spacings, yet the sizes, dimensions and/or configurations of the housings need not be changed as is prevalent in the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly comprising a pair of card edge connector housings, each having a plurality of spring contacts connected thereto and each having a card edge receiving slot therein, the housings including complementary interengaging locking means for interlocking the connector housings in a first arrangement in a side-by-side parallel relationship with their card edge receiving slots parallel to each other and spaced apart a first predetermined distance, a frangible means for interconnecting the connector housings in a second arrangement in a side-by-side parallel relationship with the card edge receiving slots parallel to each other and spaced a second predetermined distance apart, whereby the connector housings can be used in conjunction with each other in said second arrangement and the frangible means can be broken to allow interlocking of the connector housings for use in conjunction with each other in said first arrangement.

2. In an electrical connector assembly as set forth in claim 1, wherein said connector housings are unitarily molded of plastic material and said frangible means is formed integral therewith and wherein said connector housings are elongated and said frangible means comprise a plurality of breakable webs spaced between the housings along the length of the housings.

3. A method of fabricating an electrical connector assembly which includes a pair of card edge connector housings each having a plurality of spring contacts connected thereto and each having a card edge receiving slot therein, comprising the steps of:

forming the connector housings with complimentary interengaging locking means for locking the connector housings in a first arrangement in a side-by-side parallel relationship with their card edge receiving slots parallel to each other and spaced apart a first predetermined distance; and forming the connector housings with frangible means for interconnecting the connector housings in a second arrangement in a side-by-side parallel relationship with their card edge receiving slots parallel to each other and spaced apart a second predetermined distance;

whereby the connector housings can be used in conjunction with each other in the second arrangement and the frangible means can be broken to allow interlocking of the connector housings for use in conjunction with each other in the first arrangement.

4. The method of claim 3, including the steps of breaking the frangible means and interlocking the connector housing for use in conjunction with each other in the first arrangement.

5. The method of claim 3, including the steps of unitarily molding said connector housings of plastic material with a plurality of frangible means integral therewith and positioned between, and the length of the housings.

* * * * *